US009615176B2

(12) United States Patent
Pereira

(10) Patent No.: US 9,615,176 B2
(45) Date of Patent: Apr. 4, 2017

(54) AUDIO CHANNEL MAPPING IN A PORTABLE ELECTRONIC DEVICE

(71) Applicant: NVIDIA Corporation, Santa Clara, CA (US)

(72) Inventor: Mark Pereira, Livermore, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 297 days.

(21) Appl. No.: 13/730,485

(22) Filed: Dec. 28, 2012

(65) Prior Publication Data

US 2014/0185852 A1 Jul. 3, 2014

(51) Int. Cl.
*H04R 1/02* (2006.01)
*H04R 5/04* (2006.01)

(52) U.S. Cl.
CPC ..... *H04R 5/04* (2013.01); *H04R 2420/03* (2013.01); *H04R 2420/05* (2013.01)

(58) Field of Classification Search
CPC ..... H04R 5/02; H04R 2499/15
USPC ..... 381/300, 306, 333
See application file for complete search history.

(56) References Cited

U.S. PATENT DOCUMENTS

2008/0146289 A1* 6/2008 Korneluk ..... H04M 1/6041 455/569.1
2011/0002487 A1* 1/2011 Panther ..... H04R 5/04 381/300
2011/0249073 A1* 10/2011 Cranfill ..... H04N 7/147 348/14.02
2011/0316768 A1* 12/2011 McRae ..... 345/156
2013/0129122 A1* 5/2013 Johnson ..... H04R 3/12 381/306
2013/0315404 A1* 11/2013 Goldfeder ..... H04R 3/005 381/58
2013/0332156 A1* 12/2013 Tackin ..... H04M 1/6041 704/226

OTHER PUBLICATIONS

Campbell, M., "Apple Invention Adjusts Audio Based on a Display's Orientation, User Positioning", Apple Insider, http://appleinsider.com/articles/13/05/23/apple-invention-employs-sensors-and-cameras-to-adjust-audio-based-on-a-users-position, May 23, 2013, Accessed May 29, 2013, 14 pages.

* cited by examiner

*Primary Examiner* — Simon King

(57) ABSTRACT

A portable electronic device is provided having an audio subsystem with a plurality of audio devices, each of which is coupled to a logic subsystem via its own audio path. The portable electronic device may also include a display configured to present visual content, with the display being fixed in position relative to the plurality of audio devices. The portable electronic device further includes an orientation sensor electronically coupled to the logic subsystem, the logic subsystem being configured, using data received from the orientation sensor, (i) to determine whether the portable electronic device has been reoriented; and (ii) in response to such determination, vary operation of one or more of the audio paths.

17 Claims, 3 Drawing Sheets

AUDIO CHANNEL MAPPING IN A PORTABLE ELECTRONIC DEVICE

BACKGROUND

Many portable electronic computing devices such as smartphones and tablets have displays that respond to changes in orientation of the device by reconfiguring visual content to display in an upright position relative to the user. Further utility of the screen reorientation functions may be exploited by programs or applications running on the device. Many of these devices provide audio output with built-in speakers, typically two speakers providing right and left stereo outputs. Rotation of visual content in these devices can result in a mismatch between the video and audio output, e.g., rotating a device 180 degrees would result in the user experiencing right channel audio output on their left-hand side and left channel audio output on their right-hand side. This can be problematic in cases where audio and visual experiences are specifically correlated, for example in a game where audio feedback pans from right to left speakers as an object moves from right to left across the screen.

DETAILED DESCRIPTION

Modern portable electronic devices encompass a wide array of devices, including smartphones, tablets, and portable gaming consoles. These devices are increasingly being designed with touch-sensitive displays as the primary means for user interaction with device computing functions. Designs of this type may have a mostly featureless front surface area in order to maximize interface and display areas, and display functionality is often further enhanced via cooperation with orientation sensors. Specifically, many devices cause displayed content to be oriented upright for the user regardless of the changing orientation of the device relative to the ground as it is handled.

Position-sensing of these devices may depend on built-in hardware sensors, such as an accelerometer or 3-axis gyroscope, and/or supporting software and firmware including device drivers. While there are many methodologies available to indicate when a change in device orientation has occurred, subsequent changes in the orientation of the visual content as displayed may be performed automatically as a function of the device operating system communicating changes to video hardware via video drivers. Contemporary graphics processing units (GPUs), video cards, and other video display technology may be further designed to control screen rotation or reorientation by enabling communication between video hardware and position-sensing hardware directly via supporting hardware or software functions.

In contrast, audio content delivery in existing systems is not affected by changes in the position of the device. Audio hardware in these devices typically includes built-in speaker systems that are fixed on the device housing with corresponding pre-set audio output channels. While speaker placement may vary, a typical configuration has speakers placed on the right and left sides of the device when held in a "common-use" position, for example. Changes to the position of the device and subsequent changes to visual content as determined by automatic display reorientation may lead to a mismatched audio experience as heard if there is no corresponding reorientation of audio output. This may be especially problematic when the user experiences audio output that is specifically correlated to the orientation of visual content. The example embodiments and methods as described herein address varying audio operation on a portable electronic based on changes in device positioning.

Figure 1:
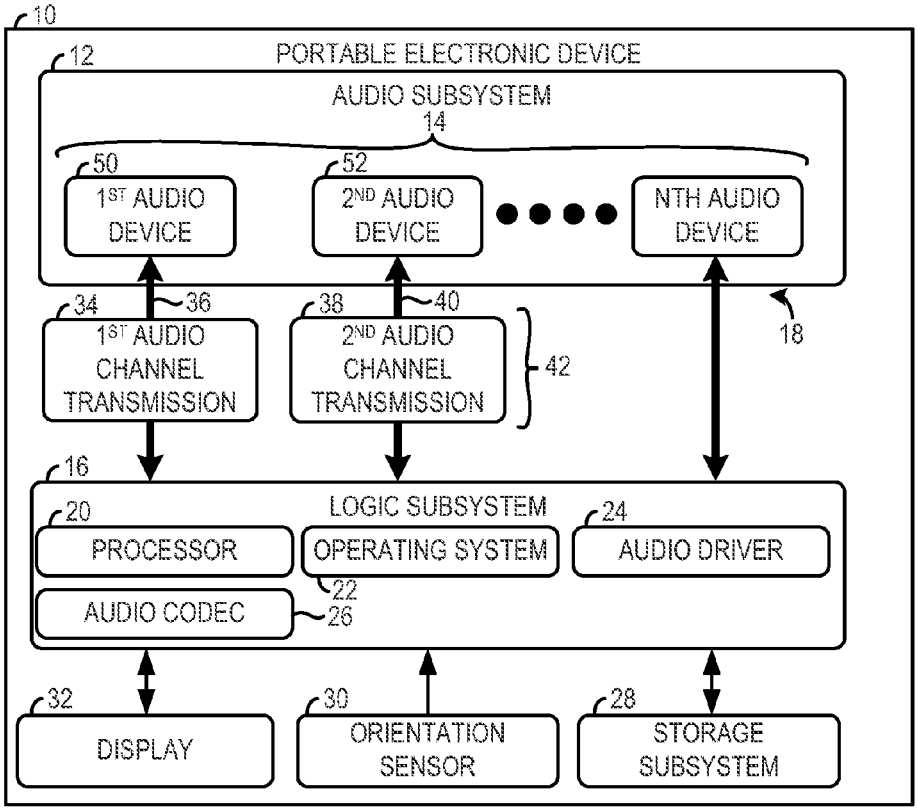
FIG. 1 shows a schematic depiction of a portable electronic device.

FIG. 1 shows a schematic depiction of a portable electronic device 10. Exemplary portable electronic devices may include but are not limited to laptop computers, mobile communication devices (e.g., smartphones), portable media players, tablet computing devices, portable gaming devices, etc.

The portable electronic device 10 includes an audio subsystem 12 having a plurality of audio devices 14. The audio devices 14 may include speakers, microphones, or other devices for transmitting and receiving audio. In speaker configurations, the speakers may each be configured to generate an audio output from an audio channel transmission in an audio signal (e.g., a polyphonic signal). Microphones may be configured to receive an audio input from the surrounding environment and convert the audio input into an audio channel transmission.

Each of the audio devices included in the plurality of audio devices 14 are electronically coupled to a logic subsystem 16 via their own audio path 18. The audio paths 18 may include wired and/or wireless audio paths.

The logic subsystem 16 includes one or more physical devices configured to execute instructions. For example, the logic subsystem may be configured to execute instructions that are part of one or more applications, services, programs, routines, libraries, objects, components, data structures, or other logical constructs. Such instructions may be implemented to perform a task, implement a data type, transform the state of one or more components, or otherwise arrive at a desired result.

The logic subsystem 16 may include one or more processors, such as processor 20, configured to execute software instructions. The logic subsystem 16 may also include an operating system 22 configured to manage hardware resources in the device and provide a platform for application programs. The logic subsystem 16 may also include an audio driver 24 configured to control the audio devices 14. The audio driver 24 may be an application/program, in some examples. Additionally, the logic subsystem 16 may include audio codec 26 configured to compress and/or decompress audio data transmitted to or received from the audio devices 14. The audio codec 26 may include an application/program, in some examples. Further in some examples, the audio codec 26 may include one or more hardware components. The hardware components may be configured to encode an analog audio signal into a digital audio signal and decode a digital audio signal into an analog audio signal. Additionally or alternatively, the logic subsystem 16 may include one or more hardware or firmware logic machines configured to execute hardware or firmware instructions. The processors of the logic subsystem may be single-core or multi-core, and the programs executed thereon may be configured for sequential, parallel or distributed processing. The logic subsystem may optionally include individual components that are distributed among two or more devices, which can be remotely located and/or configured for coordinated processing. Aspects of the logic subsystem may be virtualized and executed by remotely accessible networked computing devices configured in a cloud-computing configuration.

The portable electronic device 10 may further includes a storage subsystem 28 in electronic communication (e.g., wired and/or wireless communication) with the logic subsystem 16. The storage subsystem 28 includes one or more physical, non-transitory, devices configured to hold data and/or instructions executable by the logic subsystem to implement the herein-described methods and processes. When such methods and processes are implemented, the state of storage subsystem 28 may be transformed—e.g., to hold different data.

The storage subsystem 28 may include removable media and/or built-in devices. Storage subsystem 28 may include optical memory devices (e.g., CD, DVD, HD-DVD, Blu-Ray Disc, etc.), semiconductor memory devices (e.g., RAM, EPROM, EEPROM, etc.) and/or magnetic memory devices (e.g., hard-disk drive, floppy-disk drive, tape drive, MRAM, etc.), among others. Storage subsystem 28 may include volatile, nonvolatile, dynamic, static, read/write, read-only, random-access, sequential-access, location-addressable, file-addressable, and/or content-addressable devices. In some examples, logic subsystem 16 and storage subsystem 28 may be integrated into one or more unitary devices, such as an application-specific integrated circuit (ASIC), or a system-on-a-chip.

The portable electronic device 10 further includes an orientation sensor 30 configured to indicate an orientation of the portable electronic device 10. The orientation sensor 30 may include one or more accelerometers. However, additional or alternate suitable orientation sensor components have been contemplated. The orientation sensor 30 is in electronic communication with the logic subsystem 16. Therefore, the orientation sensor 30 is configured to send orientation data to the logic subsystem 16.

The portable electronic device 10 further includes a display 32 configured to present visual content. Specifically, the display 32 may be used to present a visual representation of data held by storage subsystem 28. This visual representation may take the form of a graphical user interface (GUI). As the herein described methods and processes change the data held by the storage subsystem, and thus transform the state of the storage subsystem, the state of the display 32 may likewise be transformed to visually represent changes in the underlying data. The display 32 may include one or more display devices utilizing virtually any type of technology. Such display devices may be combined with logic subsystem 16 and/or storage subsystem 28 in a shared enclosure. Specifically in one example, the display 32 may be fixed in position relative to the audio devices 14. The display 32 may be a touch sensitive display, in one example. The portable electronic device 10 may further include input devices such as buttons, touch sensors, knobs, keyboards, cameras, etc. The input devices provide the user an input interface with the portable electronic device 10.

FIG. 1 shows the portable electronic device 10 in a first state in which a first audio channel transmission 34 is transmitted through a first audio path 36 and a second audio channel transmission 38 is transmitted through a second audio path 40. The first and second audio channel transmissions (34 and 38) are included in a polyphonic signal 42. Specifically, the first and second audio channel transmissions (34 and 38) may be left/right stereo channels. The first and second audio channel transmissions (34 and 38) and therefore the polyphonic signal 42 may be provided by first and second audio devices 50 and 52 (e.g., speakers). As show in the figure, each speaker/audio device has its own dedicated audio path, i.e., audio paths 36 and 40.

Figure 2:
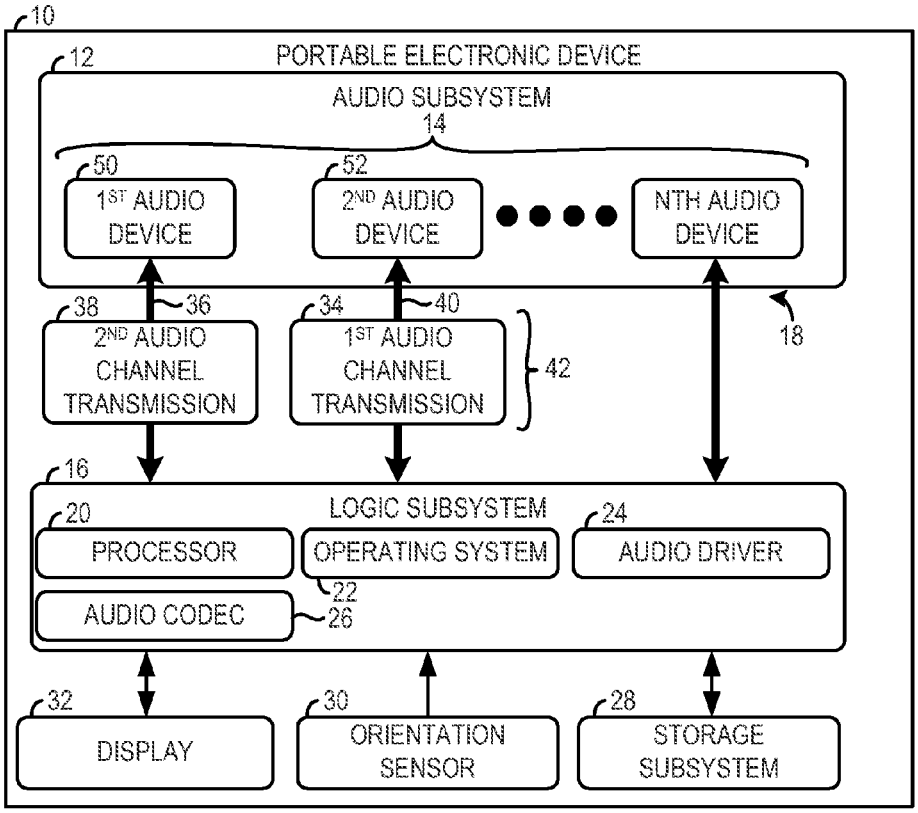
FIG. 2 depicts the portable electronic device shown in FIG. 1 in a second state in which it has been reoriented relative to the state of FIG. 1.

FIG. 2 shows the portable electronic device of FIG. 1 in a second state in which operation of the plurality of audio paths 18 has been varied. The variation may be triggered in response to a determination of rotation of the portable electronic device 10 by the logic subsystem 16. It will be appreciated that the determination of reorientation may be executed by the logic subsystem 16 based on data gathered from the orientation sensor 30. In this way, the audio content in the device may be adjusted in response to reorientation of the device to enhance the user experience.

As shown in FIG. 2, the first audio channel transmission 34 is transmitted through the second audio path 40 and the second audio channel transmission 38 is transmitted through the first audio path 36. In other words, the audio channel transmissions have been swapped based on the rotation of the device. This is one example of transferring audio associated with one path/device to another path/device. Another example is transferring audio to another path/device which was previously idle (e.g., turned off and not providing any sound).

Additionally, varying operation of the plurality of audio paths 18 may include adjusting the magnitude (e.g., volume) of audio based on device rotation. For example, the relative volume of audio in left and right speakers may be varied as the device is rotated.

In addition to speakers, other audio devices may change in operation as a result of device rotation, for example microphones. A microphone may be enabled or disabled in response to device rotation. A left-side stereo microphone may be reassigned as a right-side microphone, or vice versa, in response to device reorientation.

Logic subsystem 16 and other core hardware/software may automatically cause audio path/device operation to vary. In other examples, variation may occur selectively based on the capabilities of specific applications executing on the portable electronic device 10. For example, the audio path variation functionality may be locked to prevent unexpected or unintentional movements from affecting audio functionality. Additionally or alternatively, audio rotation may be toggled on and off by a user in a setting menu presented on the display 32, for example.

Figure 3:
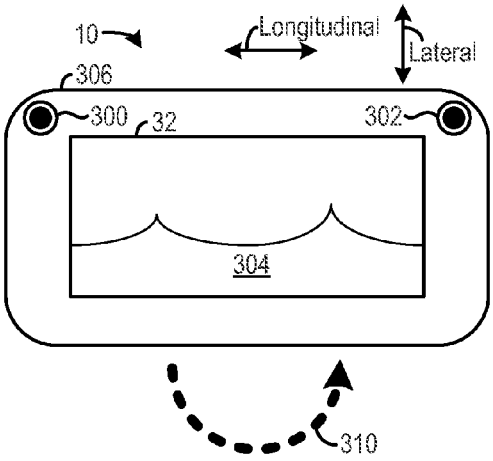
FIGS. 3 and 4 illustrate a first example portable computing device in various orientations.
Figure 4:
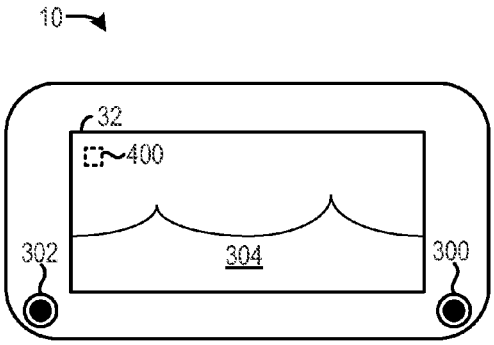

FIGS. 3 and 4 show portable electronic device 10, and illustrate examples of how audio can be affected by device rotations. The audio subsystem in the example device includes a first speaker 300 and a second speaker 302, which may be part of the audio subsystem 12 of FIGS. 1 and 2. As discussed above with regard to FIG. 1, each of the speakers may be electronically coupled to the logic subsystem 16 (FIG. 1) via its own audio path. Visual content 304 is presented on display 32.

The portable electronic device 10 includes a housing 306 which may have a continuous piece of material at least partially enclosing the first speaker 300, the second speaker 302, and the display 32. The housing 306 may also enclose additional components included in the portable electronic device shown in FIG. 1, such as the logic subsystem, storage subsystem, orientation sensor, etc. The display, housing and speakers are all fixed relative to one another.

FIG. 4 shows portable electronic device 10 rotated from the position shown in FIG. 3. Arrow 310, shown in FIG. 3, denotes the path of rotation. The logic subsystem 16, shown in FIG. 1, in the portable electronic device 10 may determine that the device has been rotated based on data received from the orientation sensor 30. In one example, it may be determined that rotation of the device has occurred when the device is rotated greater than a threshold value. In one example, the threshold value may be 90 degrees. However, other suitable threshold values are contemplated, such as 45 degrees. The rotation may be about a single axis, in one example, or about multiple axes, in other examples. The axes may extend longitudinally and laterally across the portable electronic device 10. A longitudinal axis and a lateral axis are provided for reference. However, alternate axes orientations have been contemplated. In some examples, one or more of the axes may be aligned with a gravitational axis.

Continuing with FIG. 4, in response to a determination of reorientation (e.g., rotation) operation of the audio paths electronically coupled to the first and second speakers (300 and 302) may be varied. Specifically, in the depicted example the audio channel transmissions sent through the audio paths to the first and second speakers (300 and 302) may be swapped as discussed above with regard to FIG. 2. In this way, a stereophonic signal may be adjusted based on device rotation, improving the audio content management in the device (e.g., having the audio content reorient appropriately along with reorientation of visual content).

FIG. 4 also shows the visual content 304 presented on the display 32 being adjusted (e.g., rotated) responsive to the reorientation of the device. Specifically, the visual content 304 is rotated by 180 degrees. However, other types of visual content adjustments have been contemplated. In this way, the audio and visual content provided by the device may be synchronized to enhance a user's interactive experience, and specifically to ensure proper correlation between audio and video content.

As illustrated, an optional indicator 400 presented on the display 32 may be generated by the logic subsystem 16, shown in FIG. 1, in response to the variation in operation of the audio paths. Additionally or alternatively, aural indicators may also be provided through the first speaker 300 and/or second speaker 302. In this way, visual and/or auditory indicators may alert the user of a change in the audio input and/or output of the portable electronic device 10.

Figure 5:
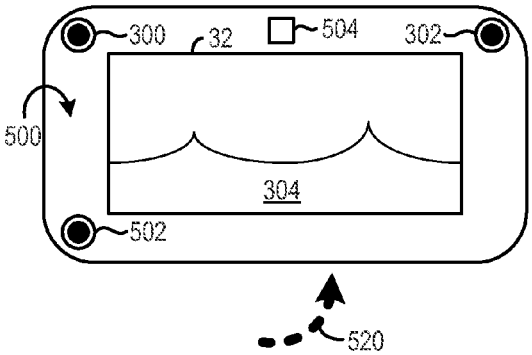
FIGS. 5-7 illustrate a second example portable electronic device in various orientations.

FIG. 5 shows another example configuration of portable electronic device 10, in which the device has a first side 500, which may be referred to as a "front" side of the device. Positioned on the front side are speakers 300, 302 and 502, which may correspond to audio devices that are part of the audio subsystem 12 of FIG. 1. As in the prior example, display 32 provides visual content 304. A camera 504 is also provided on the front side of the device.

Figure 6:
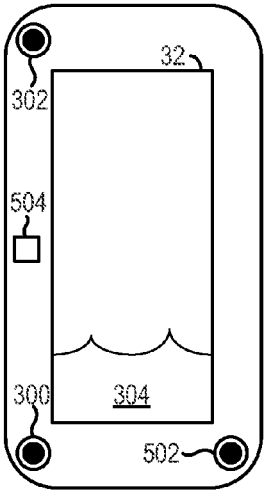

FIG. 6 shows the FIG. 5 device in a rotated position, but with the front side still facing toward the user. Arrow 520, shown in FIG. 5, indicates the path of device rotation, which in this case is approximately 90 degrees. Responsive to the rotation, operation of the audio paths in the device is varied. It will be appreciated that other amounts of rotation may trigger variation in operation of the audio paths in the device. In FIG. 6, variation of the operation of the audio paths may include transferring an audio channel transmission transmitted through an audio path corresponding to speaker 302 to an audio path corresponding to a previously-disabled speaker 502. More specifically, in FIG. 5, speakers 300 and 302 may provide respective left and right stereo channels, with speaker 502 being turned off; in FIG. 6, speakers 300 and 502 provide left and right channels while speaker 302 is turned off. Stereo presentation is thus appropriately modified in response to the change in orientation from landscape (FIG. 5) to portrait (FIG. 6).

FIG. 6 also shows the visual content 304 presented on the display 32 adjusted (e.g., rotated) 90 degrees in response to the reorientation of the device. As in the previous example, there may be a correlation between the video and audio content, such that co-incident rotational changes in video and audio provide a better user experience.

Figure 7:
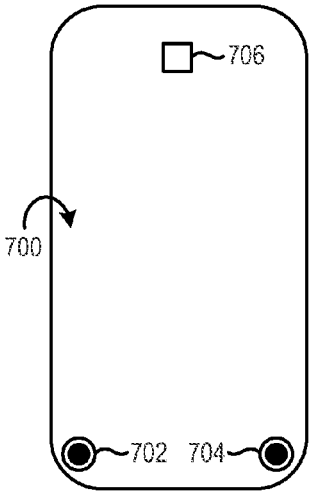

FIG. 7 shows an alternate reorientation of the device of FIGS. 5 and 6. Specifically, portable electronic device 10 has been flipped over onto a second side 700 of the device (e.g., flipping the device over so that the "back" side of the device is facing the user). Flipping may be desirable for different modes of operation, or to take advantage of different hardware features, such as to use different cameras (e.g., use backside camera 706 instead of front side camera 504, or vice versa). The portable electronic device 10 further includes speakers 702 and 704 on the back side. In response to this front-to-back rotation, the audio sent through the paths of front-side speakers 300 and 302 (FIG. 5) may be transferred to the audio paths of back-side speakers 702 and 704. As in the other examples, this orientation-based variation of speaker operation in many cases will increase device capabilities and provide a better user experience.

FIGS. 3-7 may also be used to illustrate how microphone operation can be varied in response to changes in device orientation. Referring first to FIGS. 3 and 4, assume that audio devices 300 and 302 are stereo microphones. In the orientation of FIG. 3, microphone 300 would record the left stereo channel, with microphone 302 providing the right stereo channel. In response to the sensed orientation change from FIG. 3 to FIG. 4, the left and right microphone channels would be swapped in order to appropriately correlate the stereophonic audio with the position of the device. In FIG. 5, assume that devices 300 and 302 are active as left and right microphones, respectively, with device 502 being an idle, deactivated microphone. Then, similar to the speaker example, the switch from landscape to portrait orientation (FIG. 5 to FIG. 6) would vary the operation of the audio paths associated with the different microphones. In particular, in FIG. 6, microphone 302 would become idle, and microphones 300 and 502 would be configured respectively as the left and right microphones.

Flipping the device over so that a different opposing side faces the user can also affect microphone operation, e.g., the flip from FIG. 6 to FIG. 7. Again we assume that one or more of devices 300, 302 and 504 provide microphone operation on a first side of the device, while devices 702 and 704 are microphones on the other side of the device. The flip to the orientation shown in FIG. 7 could then operate to deactivate microphones 300, 302 and/or 502, and active microphones 702 and 704.

FIGS. 6 and 7 also provide an example of a further method for sensing the orientation of the device. Specifically, cameras 504 and 706 can operate as orientation sensors that provide information used to control how the audio devices operate. Regardless of whether devices 300, 302, 502, 702 and 704 are speakers or microphones, there are a number of use scenarios where it would be desirable to activate front side devices and deactivate back side devices, and vice versa, as an example. Camera data can be processed, for example, using facial recognition to determine which side of the device was facing the user. This in turn can control whether the front or back side devices were active. In addition to camera data, orientation sensing may be implemented with a user interface (e.g., buttons or touch controls) that allows the user to provide orientation information that in turn varies operation of the audio paths. In addition to setting or specifying an orientation that affects the audio operation, user controls may be provided to lock an orientation (e.g., to disable an accelerometer-induced change in audio).

Figure 8:
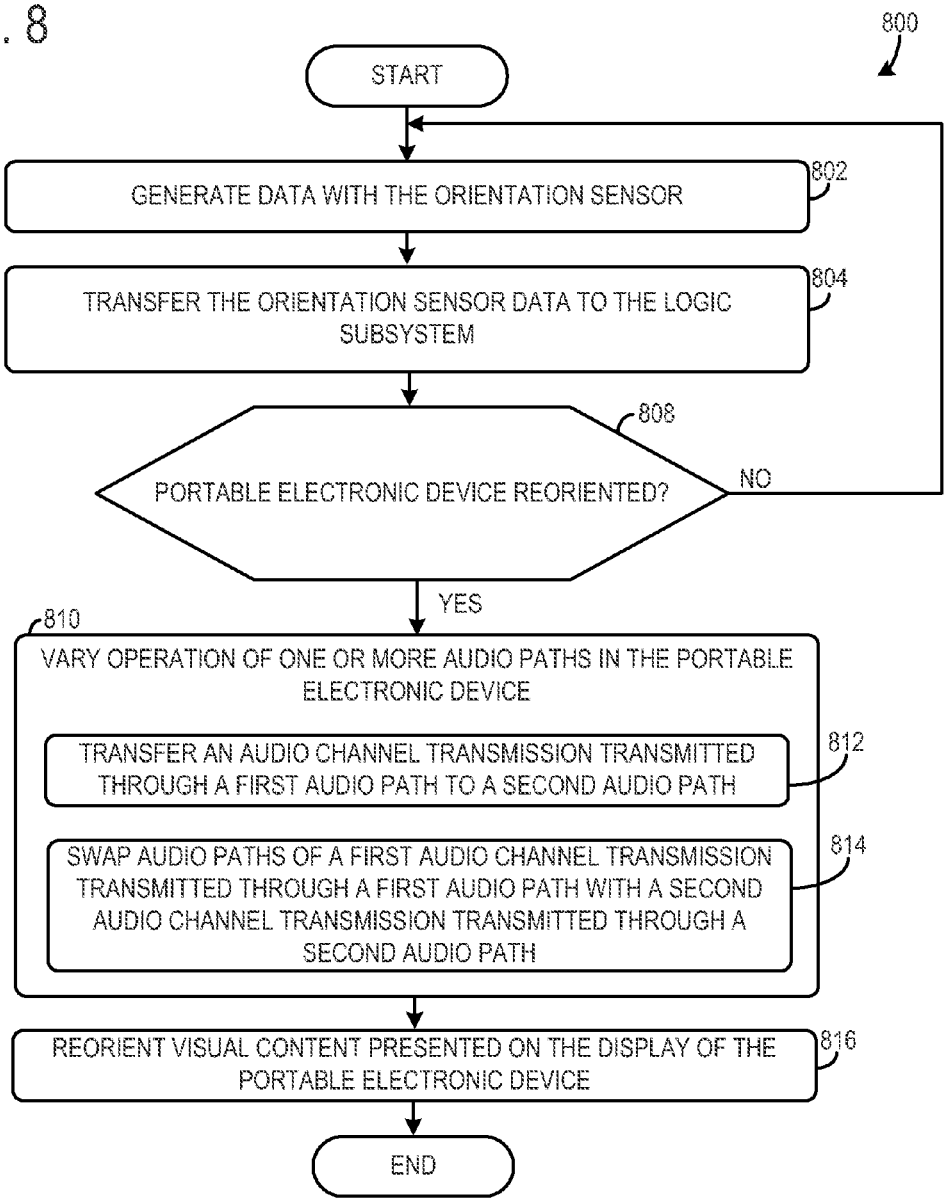
FIG. 8 shows an example method for operating a portable electronic device.

FIG. 8 shows a method 800 for operation of a portable electronic device. The method 800 may be implemented by the portable electronic device and components discussed above with regard to FIGS. 1-7 or may be implemented by other suitable portable electronic devices and components. Though implementations may vary, the method does contemplate multiple speakers or other audio devices that are fixed relative to a display that provides video content. Each audio device has its own dedicated audio path (wired and/or wireless) via which audio content flows between the audio device and a logic subsystem such as a microprocessor. An orientation sensor is coupled to the logic subsystem and provides data that is used to determine whether and how the portable electronic device has been reoriented.

At 802 the method includes generating data with the orientation sensor. Next at 804 the method further includes transferring the orientation sensor data to the logic subsystem. At 808 the method includes determining whether the portable electronic device has been reoriented based on the data received from the orientation sensor. Determining whether the portable electronic device has been reoriented may include determining if the portable electronic device is rotated greater than a threshold value. The threshold value may be 45 degrees, 90 degrees, 120 degrees, etc. As described above, orientation sensing may be implemented with accelerometers, gyroscopes and the like; with cameras or other machine vision technologies; and/or with user generated inputs applied via a user interface.

If it is determined that the portable electronic device has not been reoriented (NO at 808) the method returns to 802. Steps 802, 804, and 808 typically are implemented as a more or less continuous process of evaluating data from the orientation sensor to determine whether and how the device has been rotated. Upon a determination that the device has been reoriented (YES at 808), the method includes at 810 varying operation of one or more audio paths in the portable electronic device.

Varying operation of one or more of the audio paths in the portable electronic device may include at 812 transferring an audio channel transmission transmitted through a first audio path to a second audio path and/or at 814 swapping audio paths of a first audio channel transmission transmitted through a first audio path with a second audio channel transmission transmitted through a second audio path. As described above, varying operation of audio can include changing operation of audio paths associated with speakers, microphones or other audio devices. Audio devices can be selectively enabled and disabled, stereo channels can be swapped, etc.

In many cases, the varied audio operation occurs together with a change in presentation of video content. Indeed, as shown at 816, the method may include reorienting visual content presented on the display of the portable electronic device. As discussed above, the orientation-based change in audio operation often will provide an improved user experience in devices that vary video content in response to device rotation.

Aspects of this disclosure have been described by example and with reference to the illustrated embodiments listed above. Components that may be substantially the same in one or more embodiments are identified coordinately and are described with minimal repetition. It will be noted, however, that elements identified coordinately may also differ to some degree. The claims appended to this description uniquely define the subject matter claimed herein. The claims are not limited to the example structures or numerical ranges set forth below, nor to implementations that address the herein-identified problems or disadvantages of the current state of the art.

The invention claimed is:

1. A portable electronic device, comprising:

a housing;

an audio subsystem comprising a plurality of audio devices, each audio device is coupled to a logic subsystem via a respective audio path;

a display configured to render visual content, the display being fixed in position relative to the plurality of audio devices within the housing;

an orientation sensor electronically coupled to the logic subsystem, the logic subsystem configured, using data received from the orientation sensor, to determine whether the housing has been reoriented and responsive thereto, to vary operation of the respective audio paths, wherein the varying is configured with an operating system, and wherein further the plurality of audio devices comprises a first microphone on a first side of the housing and a second microphone on a second side of the housing opposing the first side, wherein the first side of the housing comprises the display;

wherein the orientation sensor comprises a camera; and wherein the camera and logic subsystem are collectively operative to determine which of the first and second opposing sides of the portable electronic device is facing a user and, responsive thereto, to slectively enable and disable the first and second audio microphones.

2. The portable electronic device of claim 1, wherein the varying operation of the one or more audio paths comprises swapping a first audio channel transmission transmitted through a first audio path with a second audio channel transmission transmitted through a second audio path, wherein a polyphonic signal comprises the first and second audio channel transmissions.

3. The portable electronic device of claim 2, where the polyphonic signal is generated by at least one of the plurality of audio devices and the logic subsystem.

4. The portable electronic device of claim 1, wherein the varying the operation of the respective audio paths comprises transferring a first audio channel transmission to be transmitted through a first audio path to a second audio path.

5. The portable electronic device of claim 4, wherein the second audio path is idle prior to transferring the first audio channel transmission to the second audio path.

6. The portable electronic device of claim 1, wherein the first audio device and the second audio device are selectively enabled and disabled based on the data received from the orientation sensor.

7. The portable electronic device of claim 1, wherein reorienting the housing of the portable electronic device comprises rotating the housing greater than a threshold value.

8. The portable electronic device of claim 7, wherein the threshold value is 90 degrees.

9. The portable electronic device of claim 1, wherein the operating system is configured to execute on the logic subsystem, the operating system further configured to perform the variation in operation of the one or more audio paths.

10. The portable electronic device of claim 1, further comprising an audio driver configured to execute on the logic subsystem, the audio driver configured to perform the variation in operation of the one or more audio paths.

11. The portable electronic device of claim 1, further comprising an audio codec configured to execute on the logic subsystem, the audio codec configured to perform the variation in operation of the one or more audio paths.

12. A method for operating a portable electronic device comprising a housing comprising a display and a plurality of audio devices, including a first and second microphone each on opposing sides of said housing, each audio device being fixed relative to the display and having a respective audio path via which audio is transmitted or received, the method comprising:

determining, via a camera, whether the housing of the portable electronic device has been reoriented;

in response to determining that the housing has been reoriented, varying operation of the respective audio paths, wherein the varying is configured with an operating system, and wherein the plurality of audio devices comprises a first audio device on a first side of the housing and a second audio device on a second side of the housing opposing the first side, wherein the first side of the housing comprises the display; and responsive to determining which of the first or second sides of the housing is facing a user, selectively enabling and disabling the first and second microphone.

13. The method of claim 12, wherein the varying comprises transferring an audio channel transmission to be transmitted through a first audio path to a second audio path.

14. The method of claim 12, wherein varying comprises swapping audio paths of a first audio channel to be transmitted through a first audio path with a second audio channel to be transmitted through a second audio path.

15. The method of claim 12, wherein determining whether the housing of the portable electronic device has been reoriented comprises determining if the portable electronic device is rotated greater than a threshold value.

16. A portable electronic device comprising:

a housing comprising a first side comprising a display and a second opposing side;

a first speaker coupled with a logic subsystem via a first audio path on the first side of the housing;

a second speaker coupled with the logic subsystem via a second audio path on the second side of the housing;

a first microphone coupled with a logic subsystem via a first audio path on the first side of the housing;

a second microphone coupled with a logic subsystem via a first audio path on the second side of the housing;

wherein the display is configured for presenting visual content, where the display and the first and second speakers are fixed in position relative to one another within the housing; and an orientation sensor, comprising a camera, coupled with the logic subsystem, wherein the logic subsystem is configured, using data received from the orientation sensor, to determine whether the housing has been reoriented and, responsive thereto, to swap a first audio channel transmission transmitted through the first audio path with a second audio channel transmission transmitted through the second audio path, wherein the swapping of the first audio channel transmission and the second audio transmission is configured with an operating system; and wherein the camera and logic subsystem are collectively configured for determining which of the first and second opposing sides of the portable electronic device is facing a user and, responsive thereto, to selectively enable and disable the first and second audio microphones.

17. The portable electronic device of claim 16, wherein the housing comprises a continuous piece of material at least partially enclosing the first speaker, the second speaker, and the logic subsystem.

* * * * *